US009589437B2

(12) United States Patent
McGowan et al.

(10) Patent No.: US 9,589,437 B2
(45) Date of Patent: Mar. 7, 2017

(54) PERMISSIONS-BASED ALARM SYSTEM AND METHOD

(71) Applicant: ELDORADO WALL COMPANY, INC., Boulder, CO (US)

(72) Inventors: John McGowan, Boulder, CO (US); Steven Holmes, Golden, CO (US)

(73) Assignee: ELDORADO WALL COMPANY, INC., Boulder, CO (US)

( * ) Notice: Subject to any disclaimer, the term of this patent is extended or adjusted under 35 U.S.C. 154(b) by 0 days.

(21) Appl. No.: 14/968,511

(22) Filed: Dec. 14, 2015

(65) Prior Publication Data

US 2016/0171854 A1 Jun. 16, 2016

Related U.S. Application Data

(63) Continuation of application No. 14/212,502, filed on Mar. 14, 2014, now Pat. No. 9,211,462.

(60) Provisional application No. 61/790,309, filed on Mar. 15, 2013.

(51) Int. Cl.

| | |
|---|---|
| ***G08B 13/14*** | (2006.01) |
| ***G08B 13/22*** | (2006.01) |
| ***A63B 69/00*** | (2006.01) |
| ***A63B 71/06*** | (2006.01) |
| ***A63B 9/00*** | (2006.01) |

(52) U.S. Cl.

CPC ..... *G08B 13/22* (2013.01); *A63B 9/00* (2013.01); *A63B 69/0048* (2013.01); *A63B 71/0622* (2013.01); *A63B 2071/0627* (2013.01); *A63B 2209/10* (2013.01); *A63B 2220/13* (2013.01); *A63B 2225/15* (2013.01); *A63B 2225/20* (2013.01); *A63B 2225/54* (2013.01); *A63B 2225/72* (2013.01)

(58) Field of Classification Search

CPC ..... G08B 13/22; A63B 69/0048
USPC ..... 340/572.1, 541, 573.1, 5.1, 5.2; 482/37
See application file for complete search history.

(56) References Cited

U.S. PATENT DOCUMENTS

| | | | | |
|---|---|---|---|---|
| 5,254,058 | A | 10/1993 | Savigny | |
| 5,732,954 | A | 3/1998 | Strickler et al. | |
| 7,381,154 | B1 | 6/2008 | Sudeith et al. | |
| 7,557,712 | B2 * | 7/2009 | Shelton | G08B 13/14 340/5.61 |
| 7,727,118 | B1 | 6/2010 | McCall | |
| 7,780,576 | B1 * | 8/2010 | Sudeith | A63B 21/0552 482/129 |
| 7,819,778 | B1 | 10/2010 | Sudeith | |
| 8,038,581 | B1 | 10/2011 | Sudeith | |
| 8,141,681 | B2 | 3/2012 | Brickell et al. | |
| 8,408,360 | B2 | 4/2013 | Postma | |
| 9,211,462 | B2 | 12/2015 | McGowan et al. | |

(Continued)

*Primary Examiner* — Eric M Blount

(57) ABSTRACT

Embodiments of the present disclosure provide a permissions-based alarm system for use in climbing environment. The permissions-based alarm system includes an identification device storing a permission setting relating to an aspect of the climbing environment and a detection module in communication with the identification device. The detection module detects the permission setting stored on the identification device and detects proximity of the identification device to an area restricted by the permission setting. When the identification device enters the restricted area of the climbing environment, an alert is provided.

20 Claims, 13 Drawing Sheets

(56) References Cited

U.S. PATENT DOCUMENTS

| | | | | |
|---|---|---|---|---|
| 2007/0285241 | A1* | 12/2007 | Griebenow | G06Q 10/08 340/572.1 |
| 2008/0185221 | A1 | 8/2008 | Postma | |
| 2009/0015371 | A1 | 1/2009 | Bocquet et al. | |
| 2010/0231402 | A1 | 9/2010 | Flynt et al. | |
| 2012/0038456 | A1* | 2/2012 | Pikkarainen | G08B 13/181 340/5.61 |
| 2012/0279801 | A1 | 11/2012 | Watson et al. | |
| 2014/0266720 | A1 | 9/2014 | McGowan et al. | |

* cited by examiner

10

102

PERMISSIONS-BASED ALARM SYSTEM AND METHOD

CROSS-REFERENCE TO RELATED APPLICATIONS

The present application is a continuation application and claims priority to U.S. patent application Ser. No. 14/212,502, filed Mar. 14, 2014, entitled "PERMISSIONS-BASED ALARM SYSTEM AND METHOD," now issued U.S. Pat. No. 9,211,462, which claims the benefit of U.S. Provisional Application Ser. No. 61/790,309 filed Mar. 15, 2013, all of which are expressly incorporated herein by reference. To the extent appropriate, a claim of priority is made to all of the preceding applications.

INTRODUCTION

Rock climbing is a popular activity enjoyed both indoors and outdoors. When climbing, for instance, at rock climbing facility, climbers are sometimes monitored by facility staff. However, there may be times when staff members are unable to monitor each climber. In such instances, it is desirable to have a system where a climber's activities may be restricted based on permissions. For instance, a climber may not be permitted to climb above a certain height without specific equipment, or a less experienced climber may not be permitted to enter an advanced climbing area.

PERMISSIONS-BASED ALARM SYSTEM AND METHOD

Embodiments of the present disclosure enable methods and systems for providing a permissions-based alarm system. Such embodiments may be useful when a user (e.g., a climber) enters a restricted area without permission (e.g., exceeds a defined height on a climbing wall without being connected to a rope or belay mechanism, attempts to use a piece of equipment without permission, enters a particular climbing area, or ascends a wall without a specific level of certification), an alarm may sound to alert the user (and/or facility staff) of a breach of the restricted area. The alarm may sound before the breach occurs, and may continue to sound until the breach has been resolved.

According to one embodiment, a permissions-based alarm system for use in climbing environment comprises an identification device storing a permission setting relating to an aspect of the climbing environment and a detection module in communication with the identification device. The detection module detects the permission setting stored on the identification device and detects proximity of the identification device to an area restricted by the permission setting. When the identification device enters the restricted area of the climbing environment, an alert is provided.

According to another embodiment, a permissions-based method for use in a climbing environment includes receiving a permission setting from an identification device worn by a user of the climbing environment, detecting a permission setting stored on the identification device, detecting proximity of the identification device to an area restricted by the permission setting, and when the identification device enters the restricted area, providing an alert.

According to another embodiment, a permissions-based alarm system for use in climbing environment comprises an identification device configured to store a permission setting; a supplemental device configured to store equipment identification information; and a plurality of climbing zones.

Each climbing zone includes a detection module in communication with the identification device and the supplemental device and further comprising: an antenna module configured to detect the permission setting stored on the identification device and, if present, equipment information stored on the supplemental device and further configured to detect proximity of the identification device and the supplemental device to an area restricted by the permission setting; a device reader configured to receive the detected permission setting and equipment information from the antenna module and determine a permission level; and an alarm module configured to provide an alert if the identification device enters the restricted area without permission or if the device reader does receive the equipment information.

BRIEF DESCRIPTION OF THE DRAWINGS

Non-limiting and non-exhaustive embodiments are described with reference to the following figures in which.

DETAILED DESCRIPTION

Various embodiments are described more fully below with reference to the accompanying drawings, which form a part hereof, and which show specific exemplary embodiments. However, embodiments may be implemented in many different forms and should not be construed as limited to the embodiments set forth herein; rather, these embodiments are provided so that this disclosure will be thorough and complete, and will fully convey the scope of the embodiments to those skilled in the art. Embodiments may be practiced as methods, systems or devices. The following detailed description is not to be taken in a limiting sense.

Figure 1:
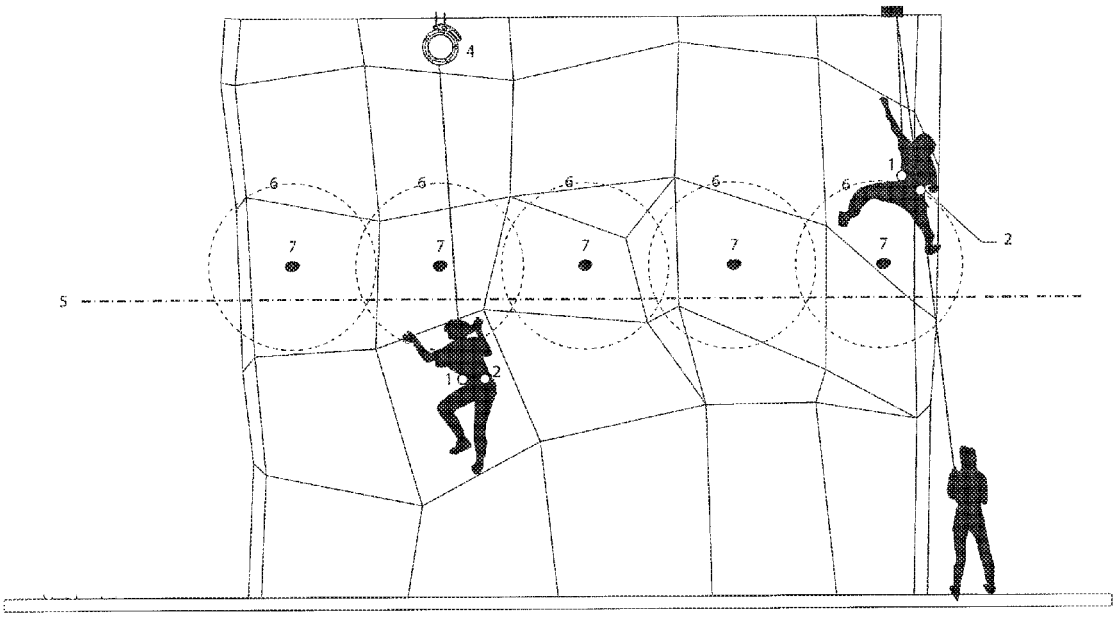
FIG. 1 illustrates a permissions-based alarm system used in a climbing facility according to one or more embodiments disclosed herein.

FIG. 1 illustrates a permissions-based alarm system 10 used in a climbing facility, according to one or more embodiments disclosed herein. As shown in FIG. 1, the system 10 may be implemented in a climbing environment. The system 10 may also be implemented with any other recreational, commercial, industrial or like environment where a user's access to a location may be selectively permitted. The system 10 may generally include an identification device 1 and a detection module 20. Information stored on the identification device 1 may be detectable by the detection module 20 within a specified range of a detection module 20 component (e.g., an antenna).

The identification device 1 may be a non-contact transmitting device (e.g., a radio frequency identification (RFID) device) capable of storing and wirelessly transmitting data from the device to another component (e.g., a device reader, described in detail below). For instance, in some embodiments, the identification device may be a small form factor device (e.g., a small RF transmitter). The identification device 1 and/or the supplemental device 2 (described in greater detail below) may be externally powered by another device (e.g., a passive RFID tag). For instance, the identification device 1 and/or the supplemental device 2 may receive RF energy from a reader, and may use the received energy to power internal circuitry and respond to interrogations with a unique code. Alternatively, the identification device 1 and/or the supplemental device 2 may be active or semi-active devices, which may use an internal battery for power. Identification device 1 memory may be of any capacity, and may typically range from about 64 bits up to about 4 KB. Identification devices may be read-write until programmed, and read-only once programmed, and may be modified only by facility staff. Identification devices may also be deactivated if needed.

The identification device 1 may be formed from a flexible or rigid material, and may be impervious to human contact. The identification device 1 may be attachable to or wearable by a user. In some embodiments, the identification device 1 may be embedded into a user's equipment or in a standard user access card or device (e.g., a membership card, punch card, etc.). For instance, the identification device 1 may be attached to a user, a bracelet, safety pin, a carabiner, hook and loop material, a harness, embedded in a proximity access card or device, or otherwise fixed the user or the user's clothing or equipment, or in direct proximity to the user.

The identification device 1 may be programmed with user-specific information, including a permissions-level. For instance, continuing with the climbing facility example, in order to gain access to a climbing wall, or an area within a climbing facility that requires special training or equipment, a user would be issued, and be required to carry or wear, an identification device 1 (e.g., a card, badge or tag) to access the area. In some embodiments, a climbing facility may program and issue member or guest identification devices (e.g., at the front desk). Thus, a facility may be equipped with a system for programming the identification cards. Other pre-programmed information specifically relating to the user may include a certification level (e.g., certified to use certain equipment or techniques such as auto-belay, top rope, lead climb, ice climb, etc.) member number, membership status, access privileges (e.g., permission to access climbing area but not weight room) may all be stored on the device. Different types of access may be given to different users. For instance, access may be based on a level of certification, user age, user height, etc.

In some instances the system may include a supplemental device 2 detectable by a component of detection module 20. A supplemental device 2 may include one or more of the features set forth above with respect to the identification device 1. The supplemental device 2 may be attachable to a required piece of equipment, a second form of identification, etc., to provide another level of permission for a user. For instance, a second RF-type device may be embedded or connected to an end of a climbing rope (e.g., a climbing rope controlled by an autobelay device that automatically protects a climber against falls) in use in the facility, or any other type of climbing assistance device. In some embodiments, the supplemental device 2 may be embedded in a textile pouch, permanently or semi-permanently affixed to an object, heat shrunk, or otherwise secured to the object. The supplemental device 2 (e.g., a device employed with a rope or lanyard) may be programmed with data. Such data may include route type (e.g., bouldering, top rope, lead climbing, auto belay climbing, ice climbing, etc.), proximity of a route to an RF field or other route information (e.g., difficulty, the name of the route setter, the date the route was set, wall height, allowable height before an alert is activated, etc.). Such data may further include a replacement or inspection interval of climbing equipment (e.g., a rope, a lanyard, an auto belay device, etc.). Such data may be hand programmed. In instances where replacement or inspection data indicates an issue with the equipment, the detection module 20 may be programmed to prevent access to the area (e.g., by providing an audible alert) until an inspection or re-certification of the equipment has been met. It should be noted that while the device is referred to herein as "supplemental" for ease of reference, the supplemental device 2 may be the only device needed to gain access to an area (e.g., in scenarios where a climber does not need to carry personal identification, but does need to be using certain equipment which has been tagged with an identification device 1).

Figure 2:
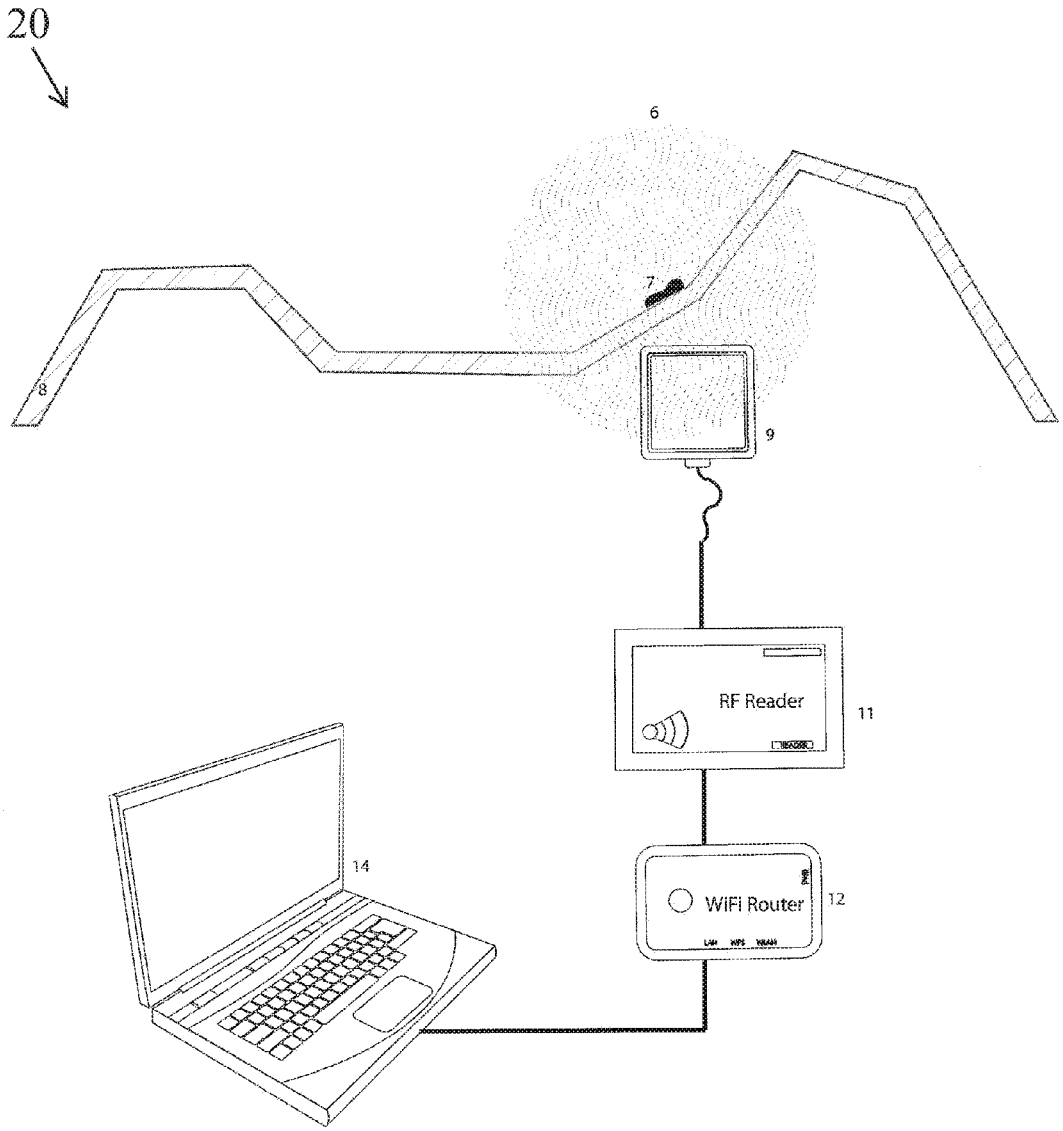
FIG. 2 illustrates a detection module of a permissions-based alarm system according, to one or more embodiments disclosed herein.
Figure 3:
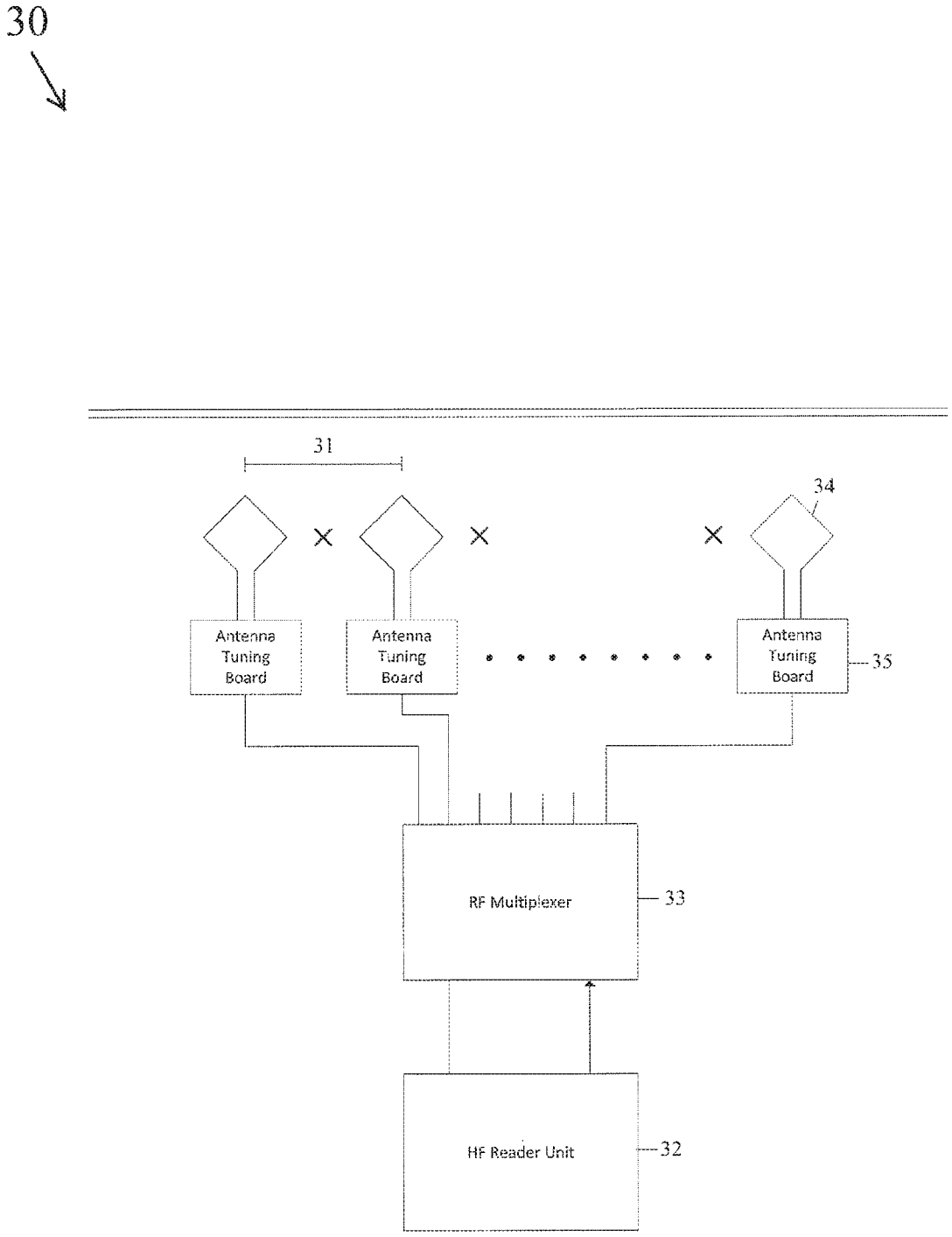
FIG. 3 illustrates a high frequency schematic of a detection module of a permissions-based alarm system including a single access zone, according to one or more embodiments disclosed herein.
Figure 4:
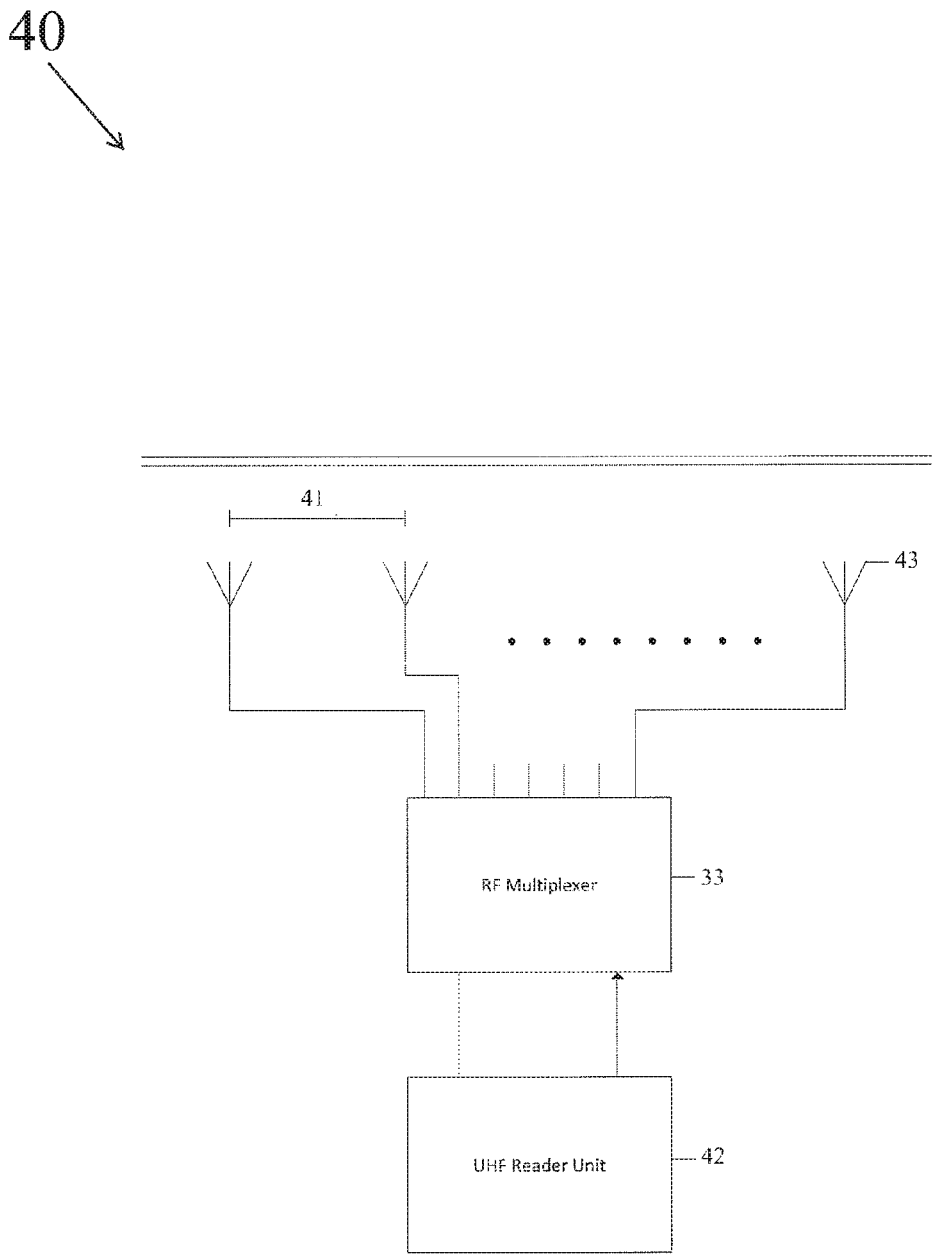
FIG. 4 illustrates an ultra-high frequency schematic of additional embodiment of a permissions-based alarm system including a plurality of access zones, according to one or more embodiments disclosed herein.

As set forth above, information stored on the identification device 1 and/or on the supplemental device 2 may be detectable by at least one component of detection module 20 when the identification device 1 is within a certain range of the detection module 20. FIGS. 2-4 illustrate various detection modules 20, 30, and 40 according to one or more embodiments disclosed herein. The detection module 20 of FIG. 2 may include at least a reader 11, an antenna module 9, and an alarm module 7. To detect information stored on the devices, determine permission levels, and trigger alerts, the detection module 20 may employ high frequency or ultra-high frequency technology for communication among the detection module 20 components. FIG. 3 illustrates a potential high frequency detection module 30. A high frequency detection module 30 may have a detection range of about four feet 31 and may employ a high-power adjustable reader 32 (e.g., about 1 W to 5 W ERP), an RF multiplexer 33 and an antenna 34 (e.g. a loop antenna with a 20" diameter). As shown in FIG. 3, in high frequency detection module scenarios, a tuning board 35 may be utilized to assist the antenna with detection. FIG. 4 illustrates an ultra-high frequency detection module 40. An ultra-high frequency detection module 40 may have a detection range 41 of about six feet and may employ an ultra-high frequency reader 42 with adjustable RF transmit power (ranging from about 0.05 W to about 4 W), an RF multiplexer 33 and a relatively simple antenna 43 (e.g. a patch antenna). Other frequency ranges are contemplated, and the described disclosure should not be limited to the examples set forth herein. Other suitable power and detection ranges are also contemplated.

Figure 5:
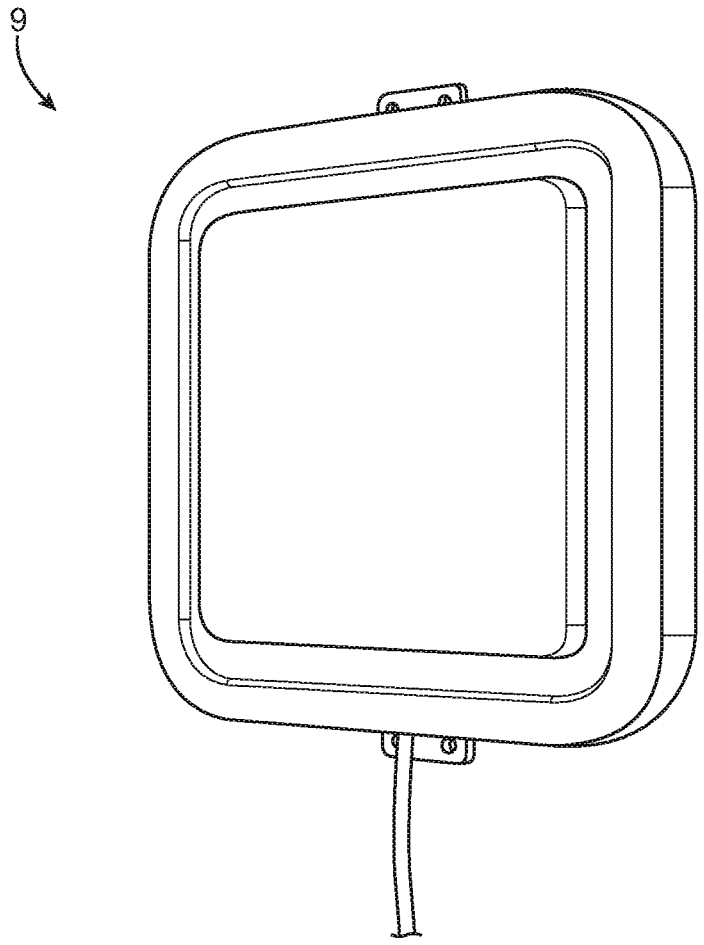
FIG. 5 illustrates an example antenna suitable for use in a permissions-based alarm system according to one or more embodiments disclosed herein.
Figure 6:
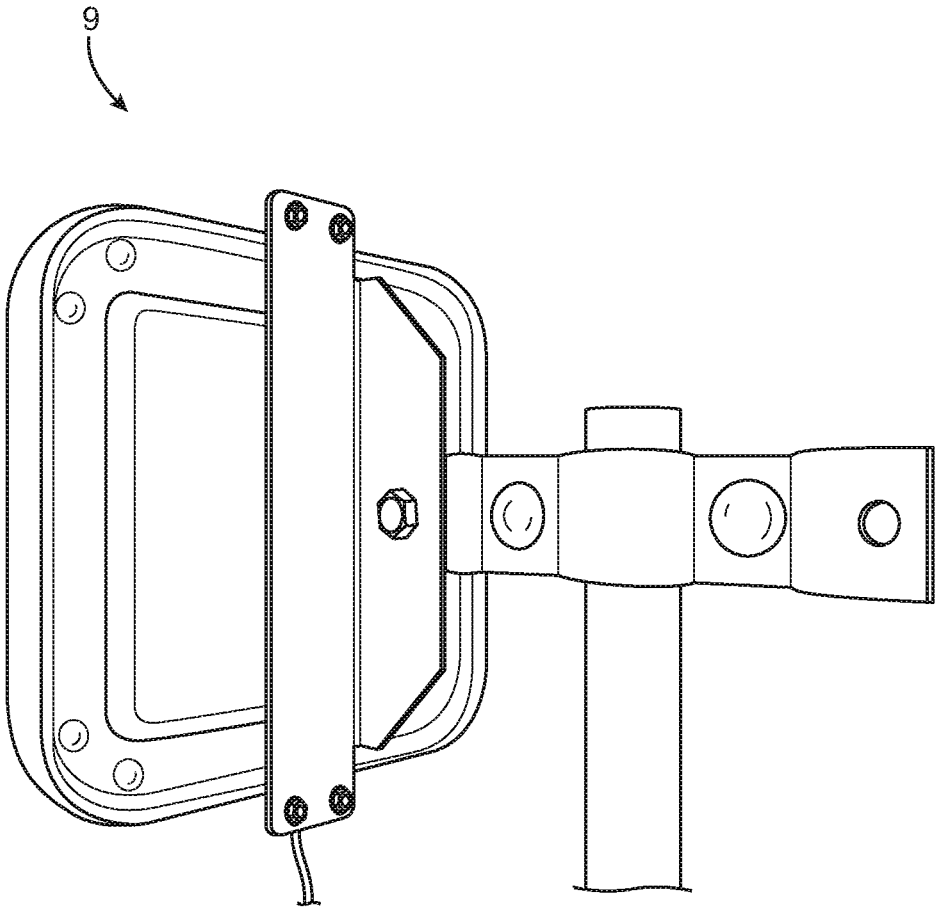
FIG. 6 illustrates an example of a mounted antenna suitable for use in a permissions-based alarm system according to one or more embodiments disclosed herein.

An antenna module 9 may register proximity in distance and may be operably connected to the reader 11. FIG. 5 illustrates an example antenna module 9 suitable for use in a permissions-based alarm system according to one or more embodiments disclosed herein. FIG. 6 illustrates an example of a mounted antenna suitable for use in a permissions-based alarm system according to one or more embodiments disclosed herein. The antenna module 9 may provide detection (both information and proximity) capabilities with a certain range 6, generally determined by the type of antenna. For instance, the antenna module 9 may be able to detect any identification device 1 or supplemental device 2 when the device is within the range of the antenna and transmit the detected information to the reader 11. If the user enters into this sphere without the RF antenna detecting one or both devices, the alarm module 7 may be activated. In some embodiments, a singular antenna may provide detection capabilities for an entire zone (e.g., a narrow climbing wall). In further embodiments, an array of antennas may be employed. For instance, the antennas may be positioned side by side at specific intervals and may be positioned to overlap the respective RF field of a neighboring antenna. Any number of antennas may be utilized as desired or needed to cover a restricted region (i.e., such that no gaps are present in the RF field, in which a restricted user could pass through undetected). The antenna module 9 may include any type of antenna (e.g., a loop antenna, a patch antenna, etc.). In embodiments where a loop antenna is utilized, the loop may be mounted parallel to the surface of the wall. Given the range, the individual antenna elements may be spaced apart at, for instance, four feet intervals, measured center-to-center, to allow for overlap in adjacent antenna fields. If a climbing wall were 40' wide, it therefore may have ten reader/alarm units installed (and up to ten climbers) on the wall at any given time. In some embodiments, the antenna may have a half-sphere radiation pattern. The antenna may be circularly polarized for decreased sensitivity to identification device/supplemental device 2 orientation. If multiple antennas are used, they may be spaced apart at any interval (e.g., at about 6 feet). In ultra-high frequency scenarios, a tuning board may or may not be included.

Many climbing walls include some form of visible marking to indicate the height at which climbers are allowed to climb without being connected to a rope, sometimes referred to as the bouldering line or bouldering height. Often the bouldering line is a piece of colored tape that extends across the climbing wall at the bouldering height. In an embodiment, one or more antennas may be incorporated into a tape that is then affixed to the climbing wall at the bouldering height. In this embodiment, one or both ends of the tape could be provided with the electrical connections necessary to operate the different antennas. Other components could also be included in the tape as well as desired. For example, alarms could be built into the tape as well or, alternatively, connectors for connecting the tape at different locations to alarms located along the bouldering height could be provided.

Figure 7:
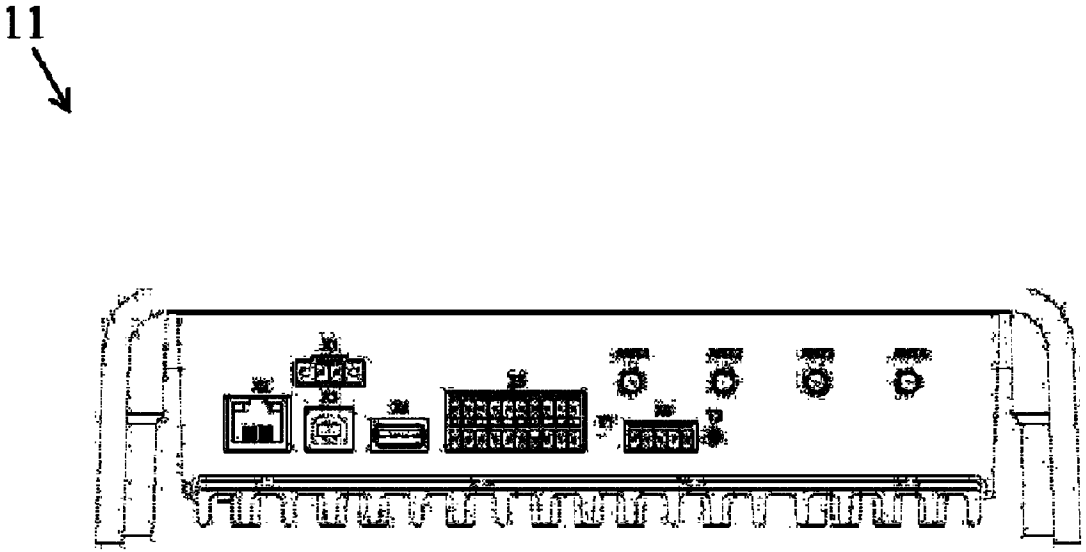
FIG. 7 is a schematic diagram of a reader suitable for use in a permissions-based alarm system according to one or more embodiments disclosed herein.

If the antenna module 9 has detected device information and proximity, the information may be transmitted to a reader 11. As indicated above, the detection module 20 may include one or more identification device reader 11 (e.g., an RFID reader or interrogator) operably connected to the antenna module 9. FIG. 7 illustrates a schematic diagram of a reader 11 suitable for use in a permissions-based alarm system according to one or more embodiments disclosed herein. The reader 11 may receive detected information stored on the identification device 1 and/or the supplemental device 2, determine a permission level and trigger an alert. The reader 11 may be enclosed in a housing and may be mountable to a surface (e.g., climbing wall). The reader 11 may be controlled through a computing system connected to the reader 11 via, for example, USB or TCP/IP. Software may be utilized to provide access to reader capabilities. Reader software may include an interface for viewing and/or modifying reader information. Additional data may also available from the reader 11 that may be useful to record (signal-to-noise ratio, received signal strength indication, etc.). As described above, the reader 11 may power the identification device 1 and/or the supplemental device 2 with RF energy, thus allowing those devices to be passive and batteryless. In some embodiments, an antenna/reader combination may be utilized.

A separate reader may be positioned at specific access points (e.g., the main entry into a climbing area). Such a reader may be programmed slightly differently (than the height alarm readers), to verify that a user who passes the threshold meets certain criteria. For example, the reader 11 may detect the presence of the required identification device, a certification level, membership status (e.g., late, current, etc.), age, or any other criteria. Additionally, the reader 11 may be linked to a physical access gate (e.g., a turnstile that is locked until access is granted, via, for example, the system described herein). In some instances, the gate access reader 11 may be a combination reader/antenna module. In some embodiments, reader 11 may be a handheld reader or a smart device reader.

Figure 8:
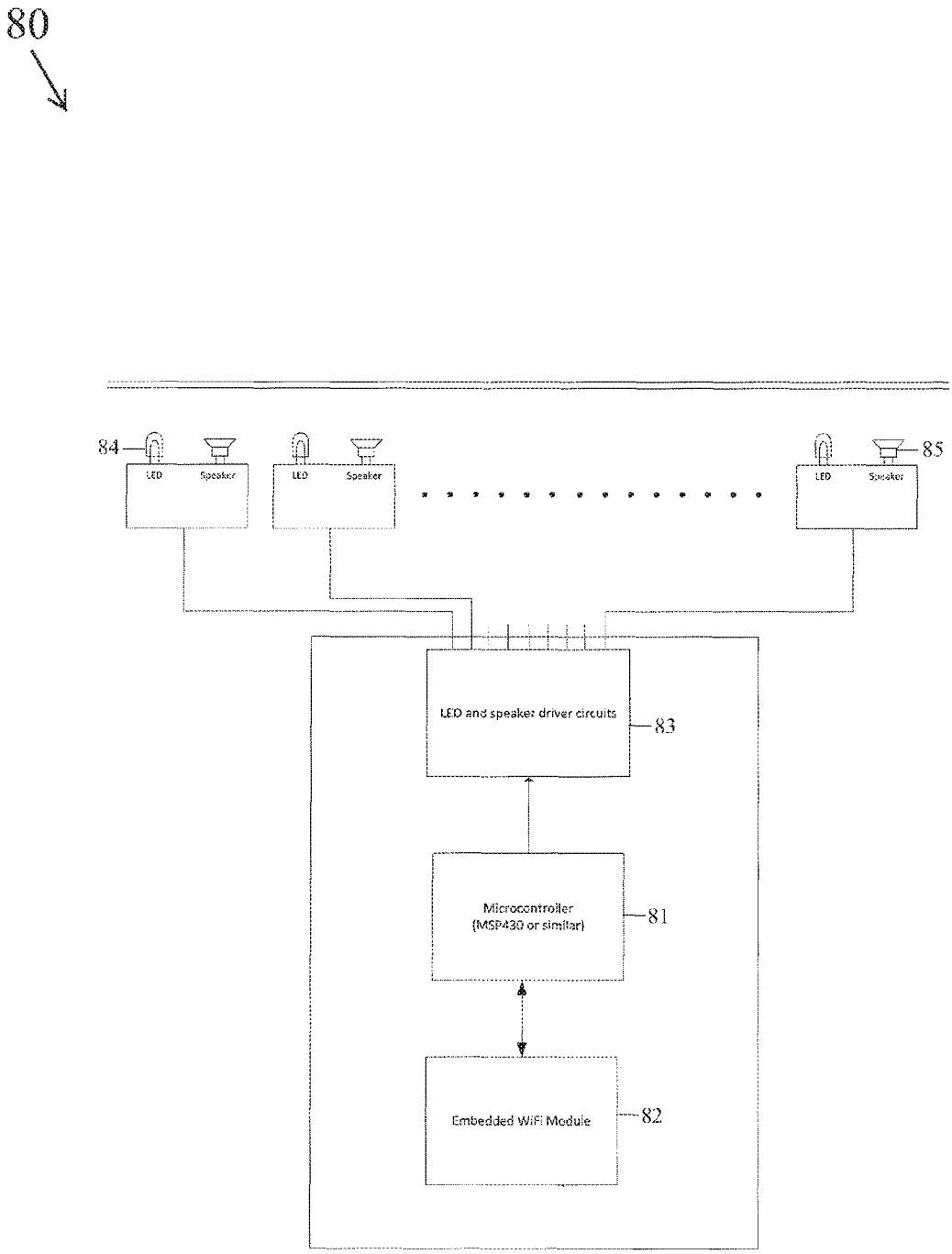
FIG. 8 illustrates a block diagram of an alarm module suitable for use in a permissions-based alarm system according to one or more embodiments disclosed herein.

If a breach occurs, that is, if one or more devices are detected and based on the information associated with the devices it is determined that an undesired condition is occurring (such as a person is climbing above the bouldering height who is not attached to a climbing rope), as determined by the reader 11, the detection module may provide an audible or visual indication of permission granted or denied via the alarm module 7. FIG. 8 illustrates a block diagram 80 of an alarm module (e.g., alarm module 7). The alarm module 7 may include a printed circuit board with a microcontroller 81 (e.g., an MSP430 microcontroller) and may include custom software to interface with an embedded wireless transmitter 82 (e.g., a Wi-Fi device) in order to accept commands from a reader and/or a centralized computing system or dedicated computing system (via, for example, 802.11) to turn on a visual alert and/or drive the audible alert system. The alarm module 7 may also include one or more light emitting diode (LED) and speaker driver circuits 83 connected to one or more LEDs 84 and/or speakers 85. In some embodiments, a printed circuit board (PCB) may host the LED/speaker/connector units 85. In other embodiments, the LED and/or speaker may be heat shrunk to the end of a cable (e.g., a R145 cable). The microcontroller 81 may be operably connected to the wireless transmitter 82 via a UART or SPI connection. The wireless transmitter 82 may utilize 802.11b/g or other such transmission interface to communicate with an access point.

The alarm module 7 may be operably connected to the reader 11 and/or the antenna module 9. The alarm module 7 may also include a battery compartment. The alarm module 7 may provide a local (in close proximity to the user), a universal alert, and/or a targeted personnel alert. Additional functionality of the alarm module 7 may include providing additional visual alerts, such via a strobe or other easily visible light source. For instance, the alarm module 7 may include a plurality of indicators having different colors. One color (e.g., green) may indicate that permission to access a restricted area is granted. Another color (e.g., red) may indicate that permission to access a restricted area is denied (and an alarm may also be activated). Additional colors (e.g., yellow) may be displayed for other events (e.g., low battery).

Figure 9A:
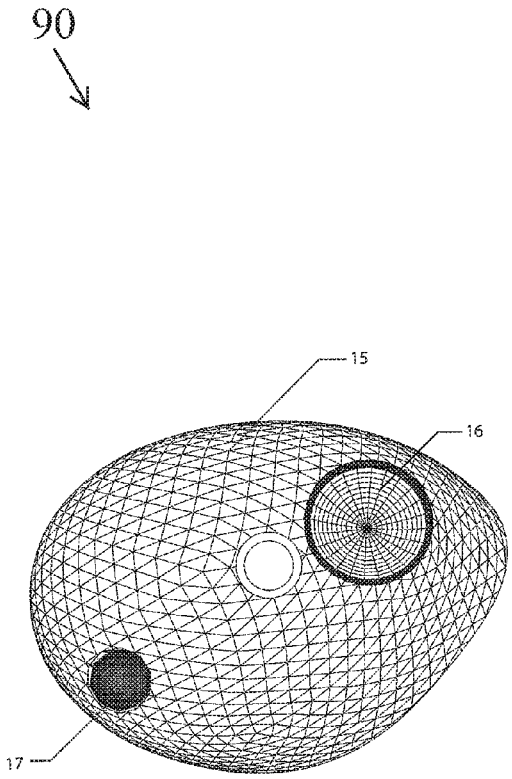
FIGS. 9A, 9B, and 9C illustrate an alarm module implemented as a climbing hold for use in a permissions-based alarm system according to one or more embodiments disclosed herein.
Figure 9B:
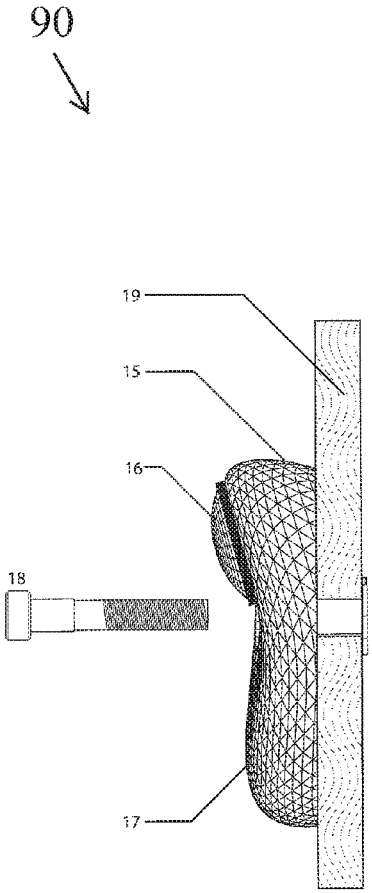
Figure 9C:
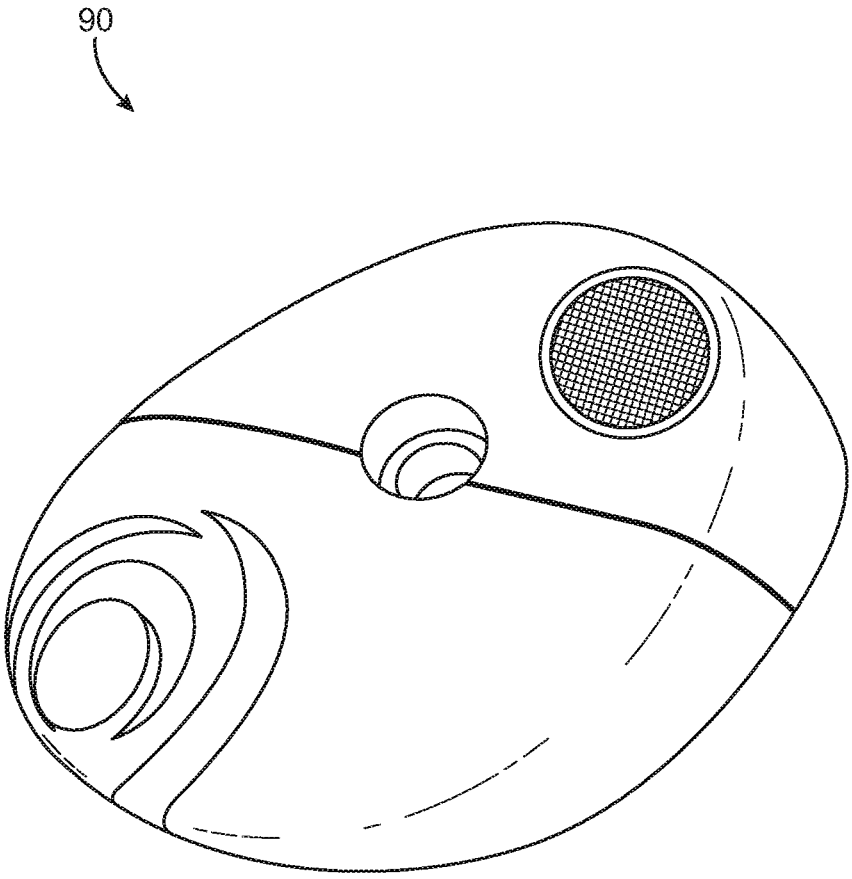

In some embodiments, the alarm module 7 may be installed as a physical component of a restricted access area (e.g., as a climbing hold of a climbing wall positioned at a pre-established height). FIGS. 9A, 9B, and 9C illustrate a permissions-based system alarm module 7 implemented as an alarm/climbing hold 90, according to one or more embodiments disclosed herein. In some embodiments, the climbing hold enclosure 15 may be shaped like and also function as a handhold, and may include a speaker 16 to provide an audible alarm and/or a light 17 to provide a visual alarm. As can be seen in FIG. 9B, the alarm/climbing hold 90 may be mounted (e.g., to a climbing wall 19 using standard mounting bolts 18 for modular handholds universally utilized to set routes in climbing walls), or custom mounting bolts so that operators can install the alarm/climbing hold 90 onto any desired surface (e.g., climbing wall 19). Thus, the alarm/climbing hold 90 may blend in visually within a specific environment (e.g., with other handholds mounted on a climbing wall).

One or more detection module components may be installed on a section of climbing wall, or may be used to allow restricted access to a space (e.g., a weight room). Some or all of the aforementioned components may also be utilized for member check in and to test functionality of identification devices. The detection module 20 may also operate during any season, indoors or outdoors, and may also be weatherproofed appropriately for outdoor use.

As shown in FIG. 2, optional detection module components may include a Wi-Fi or Ethernet device 12 for linking to a centralized computing system 14 (e.g., central gym computing system). To provide a centralized alarm system, the system may be integrated with a centralized server or computing device (e.g., a PC, laptop, tablet, etc.). For instance, the system may be in communication with a centralized computer system of the facility, or to a separate computing device. In such embodiments, a facility may employ multiple separate zones (e.g., regions of height alarms with different sizes of climbing walls).

Figure 10:
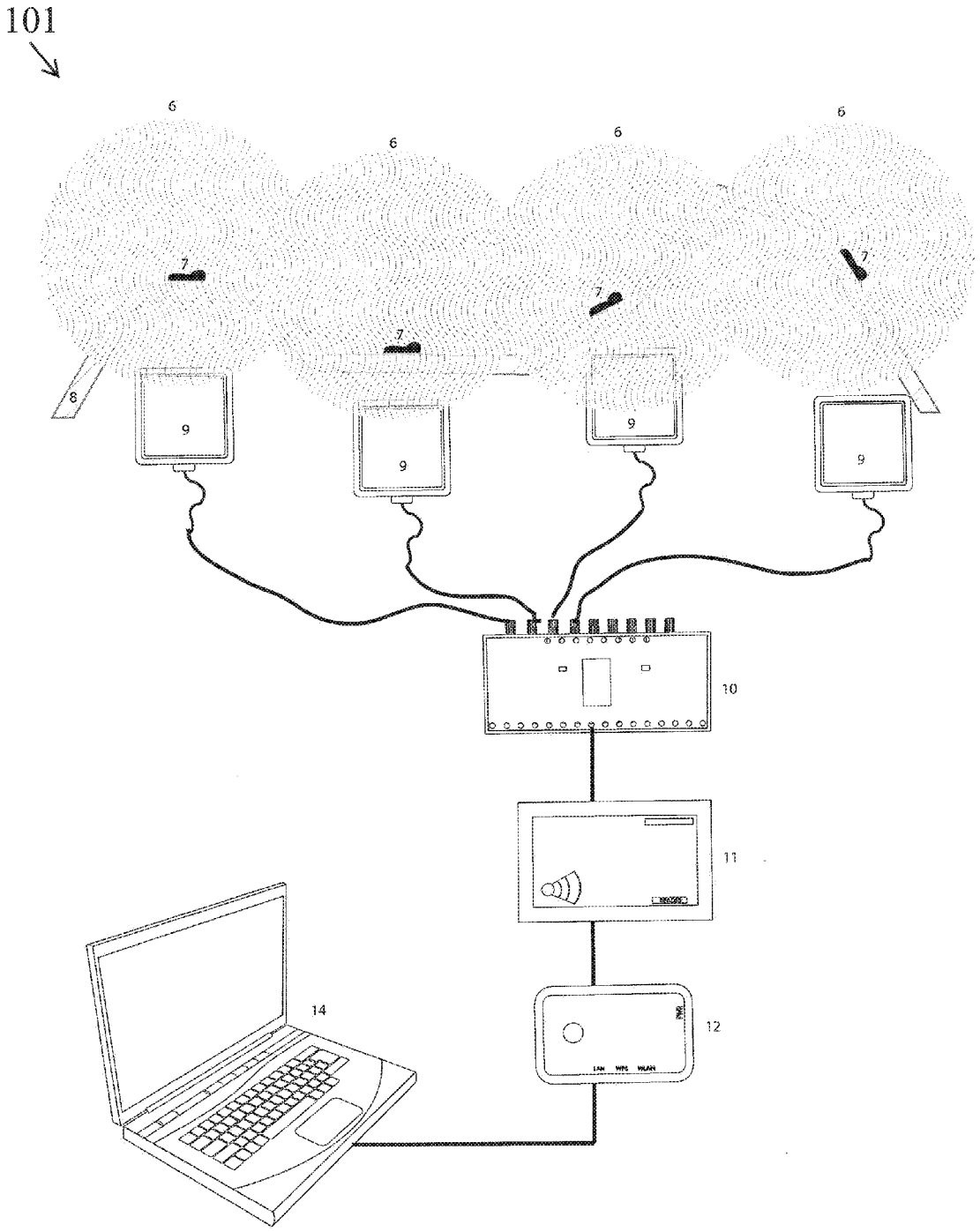
FIG. 10 illustrates a block diagram of a detection module for use in a permissions-based alarm system according to one or more embodiments disclosed herein.

In some instances, a single zone may include multiple detection modules, which may be in communication with a centralized computing system. FIG. 10 illustrates an alternative embodiment 101 of permissions-based alarm system 10 including a single access zone connected to a centralized computing system, according to one or more embodiments disclosed herein. In such embodiments, one or more alarm modules 7 may be mounted on a particular section of climbing wall (e.g., section 8 of FIG. 1) or each access zone. Localized system components, including one or more antenna modules 9, a multiplexer unit 10, an identification device reader 11 and/or a Wi-Fi or Ethernet device 12 may be installed on the back side and/or behind the climbing wall. The antenna modules 9 may be mounted at any desired height as defined by a system operator. The antennas may detect identification devices within a range 6 determined either antenna specifications. If a user enters into this sphere without the RF antenna detecting either or both devices, the alarm module 7 may be activated.

Figure 11:
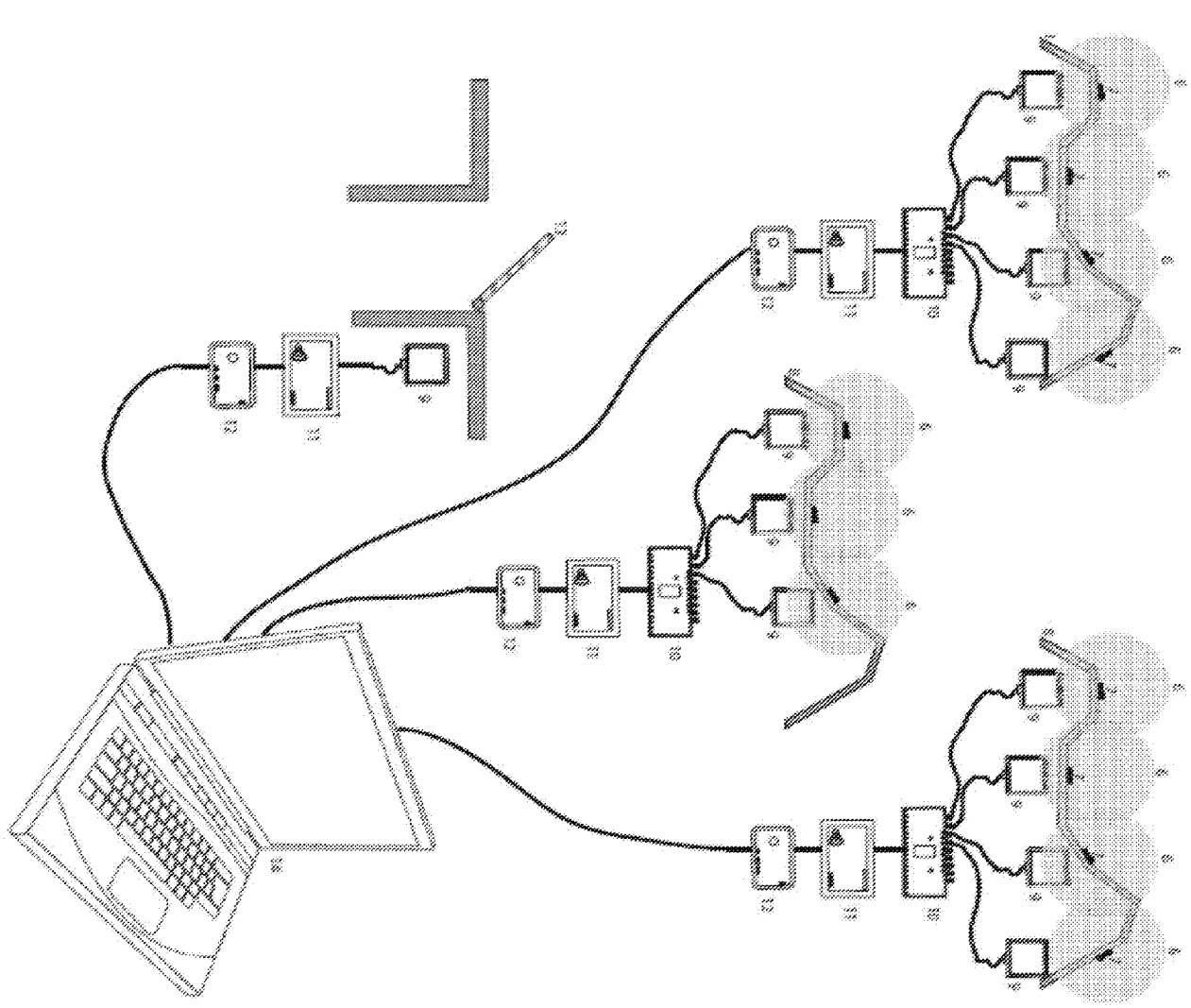
FIG. 11 illustrates an additional embodiment of a detection module for use in a permissions-based alarm system according to one or more embodiments disclosed herein.

In further embodiments, multiple detection modules may be utilized and may be in communication with a centralized computing system. FIG. 11 illustrates a further alternative embodiment 102 of permissions-based alarm system 10 including a plurality of access zones connected to a centralized computing system, according to one or more embodiments disclosed herein. One or more alarm modules 7 may be mounted on a particular section 8 of climbing wall or each access zone. Localized system components, including one or more antenna modules 9, a multiplexer unit 10, and reader 11 (e.g., RF reader) and/or a Wi-Fi or Ethernet device 12 may be installed on the back side and/or behind the climbing wall. A gate system 13 may serve as an entrance point to a climbing area, and may verify functionality of an identification device 1 and to provide access to authorized user. If a user enters into this sphere without the RF antenna detecting an identification device 1, the alarm module 7 may be activated. In some embodiments, information verified at a gate area may be linked to a centralized computing system 14.

The detection module 20 may be connected to a central database to track individual climber data (total climbs per session, collective feet of ascent, etc.) through a variety of different connection methods (hardwire internet, Wi-Fi, LAN, etc.). Custom software may be employed to track gym usage or member usage data. Since a user's identification device 1 may store information specific to a user, system software may track data usable by facility operators in day-to-day operations. For example, the system may track the popularity of particular routes or climbing structures, or the popularity of each route difficulty (to allow management to increase turnover for the most popular grades—or to change routes when they aren't popular). The facility may also track user fitness information (e.g., cumulative feet climbed in a month period), popularity or usage of particular areas, features, or styles of climbing or establish patterns (e.g., establish instances of injuries related to bouldering or auto belay usage). The system may also track compliance (e.g., if a user frequently forgets to tie in, the user may be reprimanded—or otherwise penalized).

Returning to FIG. 1, the system 10 may be implemented as a height violation alarm on a climbing wall. The climbing wall may be utilized by a plurality of users (e.g., climbers, belayers), as illustrated in FIG. 1. For instance, as depicted in FIG. 1, a user may be wearing an identification device 1 (e.g., an RF tag 1). The identification device 1 may be attached to their personal equipment (harness or clothing). The system may include a supplemental device 2 attached to a climbing rope end in close proximity to the user and a third device 4 attached to the end of a belay device such as an auto belay device. A maximum free-climb ascension height (e.g., the bouldering height) may be determined by the facility. For instance, the dashed line 5 indicates a maximum allowable height (e.g., a range from about to 8 feet to about 14 feet, or any other suitable maximum allowable height) which a user may ascend without being attached to a rope or lanyard. If a user exceeds this height, the user enters a restricted zone which may require an additional permission level. An area of the zone may be determined by a range (designated by dashed circle 6 of FIG. 1) of an antenna module 9 of the system. Thus, if a climber ascends the climbing wall with only one device registering (indicating, for instance, that the user may access the facility with using the identification device 1, but is not connected to a rope or safety lanyard, detectable with the supplemental device 2), the alarm module 7 may be activated (e.g., may emit a sound and/or begin flashing). This may alert both the climber and the facility staff that a breach has occurred. If both of the devices enter the field covered by the proximity detection system, then an alert may not be triggered and the climber may be allowed to continue into the otherwise restricted area.

In some embodiments, all identification devices within a single zone may be on the same frequency. Alternatively, each identification device, or a grouping of identification devices may be set to a specific frequency. Thus, if three chips entered into a field, suggesting one user with permission (e.g., a first climber having an identification device 1 and a rope having an attached supplemental device 2), and one user without permission (e.g., a second climber in the area without at least one device), an alert may be provided.

The alarm module 7 may provide an audible alert of entry into the restricted zone or may send an alert message to central computing system, to facility personnel, or to another designated location to address the breach of the restricted zone. The alarm module 7 may be programmed to provide a localized alert (e.g., an alarm just in front of the climber only), or in a centralized alert (e.g., more than one or all alarms activate simultaneously). Additionally or alternatively, an alarm positioned at a front desk or office may be activated, and may provide detailed of the location of the infraction. In such embodiments, the operational staff may be notified of an infraction, and can deploy personnel to the area of the breach.

Figure 12:
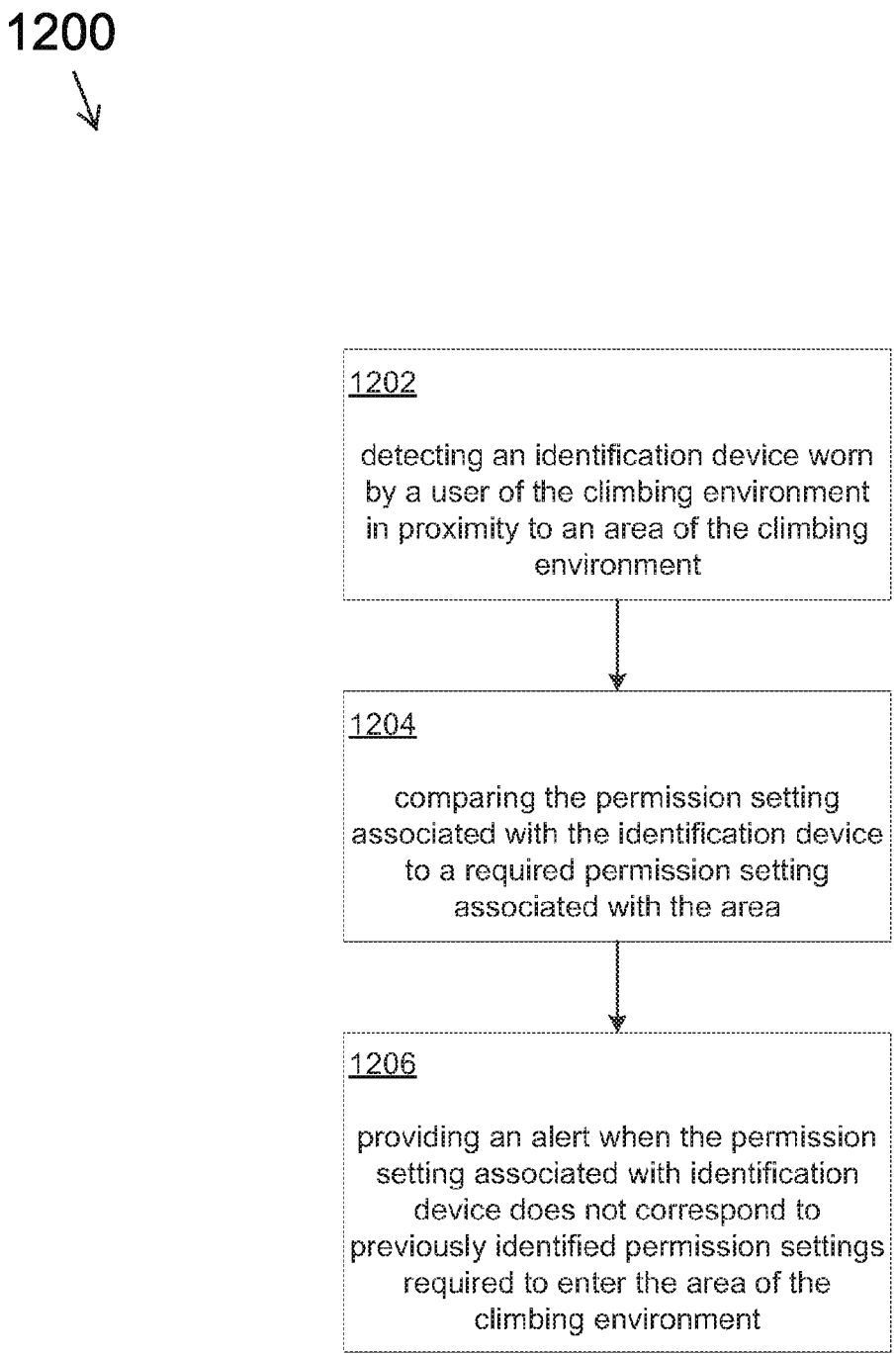
FIG. 12 illustrates a permissions-based method according to one or more embodiments disclosed herein.

FIG. 12 illustrates a method 1200 for providing permissions-based access. In some embodiments, the method 1200 may be implemented via the system components and/or applications described above with respect to FIGS. 1-11. Additional or alternative embodiments using components other than those described in FIGS. 1-11 are also contemplated. Method 1200 begins at detection operation 1202, in which a permission setting is received from an identification device as it enters an area of the climbing environment. Permission setting may be received, for instance, by the antenna of the detection module 20 described above when a wearer of the identification device comes in proximity to the antenna. Upon detection of the identification device, the permission setting is obtained by the detection module 20. Depending on the embodiment, the permission settings may be obtained as part of the detection or may be obtained after the detection from the identification device. Alternatively, the permission settings associated with the detected identification device may be obtained from a data repository accessible by the system using information from the identification device.

Upon receiving the permission setting, the detection module 20 may compare the permission setting associated with the identification device and proximity of the identification device (e.g., identification device 1) to an area restricted by the permission setting in a detection operation 1204. For example, in one embodiment, when an identification device is detected within range of a specific antenna the permission setting associated with the identification device are compared to the required permission setting or settings previous identified by the environment operator as a necessary level for access to the area associated with the antenna. When the permission setting associated with identification device does correspond to previously identified permission settings required to enter the area of the climbing environment, no alarm is generated. In some embodiments, however, all detections and associated permission levels may be stored in a log.

If, however, the detection module 20 detects that the identification device 1 is within a restricted area based on that identification device's permission setting (that is, that the permission setting associated with the identification device is not sufficient for the area being accessed), flow may proceed to alert operation 1206, in which an alert may be provided. As described above, an alert may take many forms and many different types of alerts, local and remote, may be generated simultaneously or over time based on the time that the identification device is detected within the restricted area.

It is contemplated that in addition to the functions described above, other tracking information may be gathered by the alarm system. For example, a facility may track usage of particular climbing features for popularity, or track peak usage and/or breaches during different times of the day. The facility may track route popularity, or track cumulative feet of ascent over a period (e.g., a climbing competition to climb the equivalent of Mount Everest). In addition, the facility may track incidents of injury as compared with styles of climbing (top roped, lead climbing, bouldering or Auto belay climbing). The system may further be utilized to track profitability, member satisfaction, and to generate reports of one or more of the aforementioned statistics. The system may also minimize false alarms. In alternative embodiments, the system may be hard-wired and may comprise a plurality of modules connected (e.g., in series) to accomplish the functionalities described herein.

It is further contemplated that other applications of the permissions-based alarm system are possible. For example, the system may be used construction or mining applications to provide a mechanism for detecting whether workers or miners are connected to a safety lanyard while ascending or descending from a location. The system may also be utilized to protect workers or employees from a localized or non-localized hazard. For example, a worker may be prohibited access to a specific work zone without certain equipment and/or training or certification to gain such access.

The system may further be utilized to prevent equipment from functioning. For example, imagine that an employee who was not certified in operations, or does possess the correct equipment to operate a piece of equipment (forklift, metalworking equipment, industrial manufacturing equipment, etc.). The alarm system may prevent the equipment from being operable unless the operator has a specified RF tag installed (on a safety harness, helmet, etc.), and/or the operator has the correct certification for operations of the specific equipment. In another application, the alarm system may be used to try to prevent unauthorized personnel from entering a restricted area without the proper safety equipment (e.g., respirator, helmet, steel-toed boots, etc.). In this embodiment, each piece of safety equipment may have its own supplement device (with its own equipment-specific information) embedded in or affixed to the equipment and the system may check to verify that all required equipment is present on each user entering the area.

It will be clear that the systems and methods described herein are well adapted to attain the ends and advantages mentioned as well as those inherent therein. Those skilled in the art will recognize that the methods and systems within this specification may be implemented in many manners and as such is not to be limited by the foregoing exemplified embodiments and examples. In other words, functional elements being performed by a single or multiple components and individual functions can be distributed among different components. In this regard, any number of the features of the different embodiments described herein may be combined into one single embodiment and alternate embodiments having fewer than or more than all of the features herein described are possible.

The embodiments described herein are non-limiting examples of a permissions-based alarm system. While various embodiments have been described for purposes of this disclosure, various changes and modifications may be made which are well within the scope of the disclosed methods. Variations of any component or component functionality of the system, or of the method steps are contemplated. Numerous other changes may be made which will readily suggest themselves to those skilled in the art and which are encompassed in the spirit of the disclosure.

The embodiments and functionalities described herein may operate via a multitude of computing systems including, without limitation, wired and wireless computing systems, mobile computing systems (e.g., mobile telephones, netbooks, tablet or slate type computers, and laptop computers). In addition, the embodiments and functionalities described herein may operate over distributed systems (e.g., cloud-based computing systems), where application functionality, memory, data storage and retrieval and various processing functions may be operated remotely from each other over a distributed computing network, such as the Internet or an intranet. User interfaces and information of various types may be displayed via on-board computing device displays or via remote display units associated with one or more computing devices. For example user interfaces and information of various types may be displayed and interacted with on a wall surface onto which user interfaces and information of various types are projected. Interaction with the multitude of computing systems with which embodiments of the invention may be practiced include, keystroke entry, touch screen entry, voice or other audio entry, gesture entry where an associated computing device is equipped with detection (e.g., camera) functionality for capturing and interpreting user gestures for controlling the functionality of the computing device, and the like.

What is claimed is:

1. A permissions-based alarm system for use in a limited-access environment comprising:

an identification device associated with a first permission setting related to a first area of the limited-access environment next to a second area;

a supplemental device associated with supplemental device information; and a detection system capable of detecting the identification device and the supplemental device, the detection system:

detecting the identification device in the first area;

determining that the first permission setting associated with the identification device indicates that access to the first area or the second area should be allowed only if the identification device is accompanied by the supplemental device associated with the supplemental device information;

monitoring the first area for the supplemental device associated with the supplemental device information; and detecting that the identification device enters the first area without being accompanied by the supplemental device associated with the supplemental device information, and in response to the detecting that the identification device enters the first area without detecting the supplemental device, transmitting an alert.

2. The permissions-based alarm system of claim 1, wherein the supplemental device is attached to a piece of personal safety equipment.

3. The permissions-based alarm system of claim 2, wherein the piece of personal safety equipment is selected from a respirator, a helmet, a steel-toed boot, a harness, a rope, a lanyard, and an article of clothing.

4. The permissions-based alarm system of claim 1, wherein the identification device stores a plurality of permission settings including the first permission setting and the supplemental device stores the supplemental device information and detecting proximity of the identification device further comprises:

obtaining the first permission setting from the identification device.

5. The permissions-based alarm system of claim 1, wherein the first permission setting is associated with one or more of a certification, a personal identifier, an authorization level, equipment-specific operation privileges, and location-specific access privileges.

6. The permissions-based alarm system of claim 1, wherein transmitting the alert results in one or more of activating an audible alarm, activating a visual indicator, storing information regarding detecting that the identification device enters the first area without detecting the supplemental device associated with the supplemental device information, prohibiting the access to the second area, and preventing operation of a piece of equipment.

7. The permissions-based alarm system of claim 6, wherein transmitting the alert results in preventing operation of the piece of equipment selected from a vehicle or a piece of industrial machinery.

8. The permissions-based alarm system of claim 1, wherein the detection system further includes:

a reader;

an antenna; and an alarm.

9. A permissions-based access method for use in a limited-access environment comprising:

detecting an identification device worn by a user in proximity to an area of the limited-access environment;

determining that a first permission setting is associated with the identification device and that the first permission setting requires a predetermined proximity between the identification device and a supplemental device storing first supplemental device information when the user is in proximity to the area;

monitoring for a supplemental device storing the first supplemental device information; and transmitting an alert signal in response to detecting that the identification device is in the area without the supplemental device storing the first supplemental device information being within the predetermined proximity.

10. The permissions-based access method of claim 9, further comprising:

determining that the first permission setting associated with the identification device requires the predetermined proximity between the identification device, the supplemental device storing first supplemental device information, and a supplemental device storing second supplemental device information;

monitoring for the supplemental device storing the first supplemental device information and for the supplemental device storing the second supplemental device information; and transmitting an alert signal in response to detecting that the identification device is in the area without one or both of the supplemental device storing the first supplemental device information and the supplemental device storing second supplemental device information being within the predetermined proximity.

11. The permissions-based access method of claim 9, wherein the detecting the identification device in proximity to the area includes:

detecting that the identification device has entered a work zone that requires a specified piece of safety equipment that includes the supplemental device storing the first supplemental device information.

12. The permissions-based access method of claim 9, wherein the detecting the identification device in proximity to the area includes:

detecting that the identification device is near a piece of equipment for which use of the supplemental device storing the first supplemental device information is required.

13. The permissions-based access method of claim 9, wherein transmitting the alert signal causes a combination of an audible alert via one or more audio devices and a visual alert via one or more visual alert devices.

14. A permissions-based alarm system comprising:

an identification device storing a permission setting;

a supplemental device storing equipment identification information; and a plurality of limited-access zones, each zone further including:

a detection system capable of detecting the identification device and the supplemental device, the detection system including:

an antenna that can obtain the permission setting stored on the identification device and equipment information stored on the supplemental device when the identification device and the supplemental device are within the zone or a proximity of the zone;

a device reader receiving the permission setting and the equipment information from the antenna; and an alarm module providing a signal if the identification device enters the zone without concurrently detecting the supplemental device, providing the signal being determined based on the permission setting.

15. The permissions-based alarm system of claim 14, wherein the identification device is attachable to a user and the supplemental device is a piece of safety equipment.

16. The permissions-based alarm system of claim 14, wherein the signal is transmitted to an audible alarm, a visual indicator, a vehicle, or a piece of machinery.

17. The permissions-based alarm system of claim 14, wherein the identification device is programmed with user-specific information, including a permission level associated with one or more of the plurality of limited-access zones, and wherein the permission level is utilized to determine whether equipment is necessary for a user in an associated limited-access zone.

18. The permissions-based alarm system of claim 14, further comprising:

a gate, vehicle, or piece of machinery that, upon receipt of the signal, prevents use by a user with the identification device but without the supplemental device.

19. The permissions-based alarm system of claim 14, wherein the detection system is connected to a central database that stores information related to detection of identification devices and supplemental devices.

20. The permissions-based alarm system of claim 14, wherein the detection system is further capable of detecting multiple different supplemental devices, each storing different equipment identification information, and the detection system further includes providing a second signal if the identification device enters the zone without concurrently detecting one or both of a first supplemental device storing first equipment identification information and a second supplemental device storing second equipment identification information, providing the second signal being determined based on the permission setting.

* * * * *